US005273813A

United States Patent [19]

Akamatsu et al.

[11] Patent Number: 5,273,813

[45] Date of Patent: Dec. 28, 1993

[54] FABRIC MATERIAL USEFUL FOR WIND-FILLING SPORTING GOODS

[75] Inventors: Tetsuya Akamatsu, Matsuyama; Shigeru Takahashi, Ibaraki; Katsutoshi Taniguchi, Matsuyama, all of Japan

[73] Assignee: Teijin Limited, Osaka, Japan

[21] Appl. No.: 984,419

[22] PCT Filed: Jul. 7, 1992

[86] PCT. No.: PCT/JP92/00873

§ 371 Date: Mar. 29, 1993

§ 102(e) Date: Mar. 29, 1993

[87] PCT Pub. No.: WO93/01338

PCT Pub. Date: Jan. 21, 1993

[30] Foreign Application Priority Data

Jul. 8, 1991 [JP] Japan ..... 3-192791
Oct. 24, 1991 [JP] Japan ..... 3-303904

[51] Int. Cl.[5] ..... D03D 3/00

[52] U.S. Cl. ..... 428/225; 28/240; 28/245; 28/246; 139/420 R; 428/257

[58] Field of Search ..... 428/225, 257, 910; 28/240, 245, 246; 139/420; 114/102

[56] References Cited

FOREIGN PATENT DOCUMENTS 57-176280 10/1982 Japan .
62-162016 7/1987 Japan .
63-159518 7/1988 Japan .
3-59111 3/1991 Japan .
3-59163 3/1991 Japan .

*Primary Examiner*—James J. Bell
*Attorney, Agent, or Firm*—Burgess, Ryan & Wayne

[57] ABSTRACT

A fabric material that has a high resistance to tearing and is useful for sporting goods utilizing wind pressure, for example, yacht-sails, paragliders and hanggliders, comprises a woven fabric comprising, as a principal fiber component, polyester fibers and satisfies the following specifications:

(1) a basis weight of 20 to 100 g/m$^2$,
(2) a tensile strength of 30 kg/5 cm or more,
(3) an ultimate elongation of 18% or more,
(4) a burst strengh of 0.18 kg/cm$^2$ or more,
(5) a tear strength of 1.0 kg or more, and
(6) an air permeability of 1.0 ml/cm$^2$/sec or less and preferably the polyester fibers have an intrinsic viscosity of 0.7 to 0.95, an individual fiber thickness of 1.5 to 3.0 denier, a tensile strength of 6.0 g/d or more, an ultimate elongation of 20% or more, a gradient A of a stress-strain curve at a point on the curve at which the elongation of the fibers is zero, of 1.0 or more, and a ratio B/A of a minimum gradient B of the stress-strain curve in an elongation range of from 0 to 4% to the gradient A, of 0.2 to 0.5.

3 Claims, 1 Drawing Sheet

FABRIC MATERIAL USEFUL FOR WIND-FILLING SPORTING GOODS

DESCRIPTION

1. Technical Field

The present invention relates to a fabric material useful for wind-filling sports equipment. More particularly, the present invention relates to a fabric material useful for wind-filling sports equipment, for example, paraglider, hangglider, yacht sail, spinnaker and stuntkite, which utilize wind, comprising a woven fabric formed as a main component, from polyester fibers and having an excellent resistance to tearing.

2. Background Art

Recently, trends involving sports activities have increased with an increase in leisure time. The activities have become multifarious and recently leisure type sports, for example, marine sports and sky sports, have become very popular.

In marine sports, yacht sails and spinnakers are used extensively, and in aerial sports, paragliders and hanggliders are popular. Both of these sports employ fiber-based fabrics.

Conventional fiber materials for sports comprise, as a main component, cotton and nylon fibers, and in the past nylon fibers have been more popular because they are light weight, have a high degree of strength and are attractive in appearance.

Generally, however, nylon fibers have an unsatisfactory resistance to weathering and dimensional stability and thus utilization of polyester fiber, which has an excellent resistance to weathering and good dimensional stability compared to nylon fibers, are gaining popularity.

Conventional fabric material produced from polyester fibers is satisfactory in terms of weight, resistance to weathering and dimensional stability, but unsatisfactory in its resistance to tearing. Therefore, when a polyester fiber fabric material is used for sports activities utilizing wind pressure, tearing of the material may occur, thereby resulting in an accident. Therefore, there is a strong demand for a polyester fiber fabric that is resistant to tearing.

DISCLOSURE OF THE INVENTION

An object of the present invention is to provide a fabric material having an excellent resistance to tearing and light in weight in addition to a superior resistance to weathering and a satisfactory dimensional stability, which are inherent properties of polyester fiber woven fabrics, and thus useful for sports equipment utilizing wind pressure, for example, paragliders, hanggliders, yacht sails, spinnakers and stuntkites. Another object of the present invention is to provide a fabric material comprising a polyester fiber woven fabric that is useful for producing sports equipments utilizing wind pressure.

The above-mentioned objects can be realized by the fabric material of the present invention, which is useful for wind-filling sports equipment, and comprises a woven fabric comprising, as a principal fiber component, polyester fibers and satisfies the following specifications (1) to (6):

(1) $100 \geqq$ fabric basis weight $(g/m^2) \geqq 20$ (2) tensile strength (kg/5 cm) $\geqq 30$ (3) ultimate elongation (%) $\geqq 18$ (4) burst strength $(kg/cm^2) \geqq 0.18$ (5) tear strength (kg) $\geqq 1.0$ (6) air permeability $(ml/cm^2/sec) \leqq 1.0$ In the fabric material of the present invention useful for wind-filling sports equipment, the polyester fibers also preferably satisfy the following specifications (7) to (12):

(7) $0.95 \geqq [\eta]F \geqq 0.7$ (8) $3 \geqq DPF \geqq 1.5$ (9) $ST \geqq 6.0$

(10) $EL \geqq 20.0$

(11) $A \geqq 1.0$ and

(12) $0.5 \geqq B/A \geqq 0.2$ in which $[\eta]F$ represents an intrinsic viscosity of the polyester fibers, DPF represents individual fiber thickness in denier of the polyester fibers, ST represents tensile strength in g/denier of the polyester fibers, EL represents ultimate elongation in % of the polyester fibers, A represents a gradient in g/denier/% of a stress-strain curve of the polyester fibers at a point at which the polyester fibers exhibit an elongation of zero, and B represents a minimum gradient in g/denier/% of a portion of the stress-strain curve of the polyester fibers in which a portion of the polyester fibers exhibits an elongation of from 0 to 4%.

BEST MODE OF CARRYING OUT THE INVENTION

Figure 1:
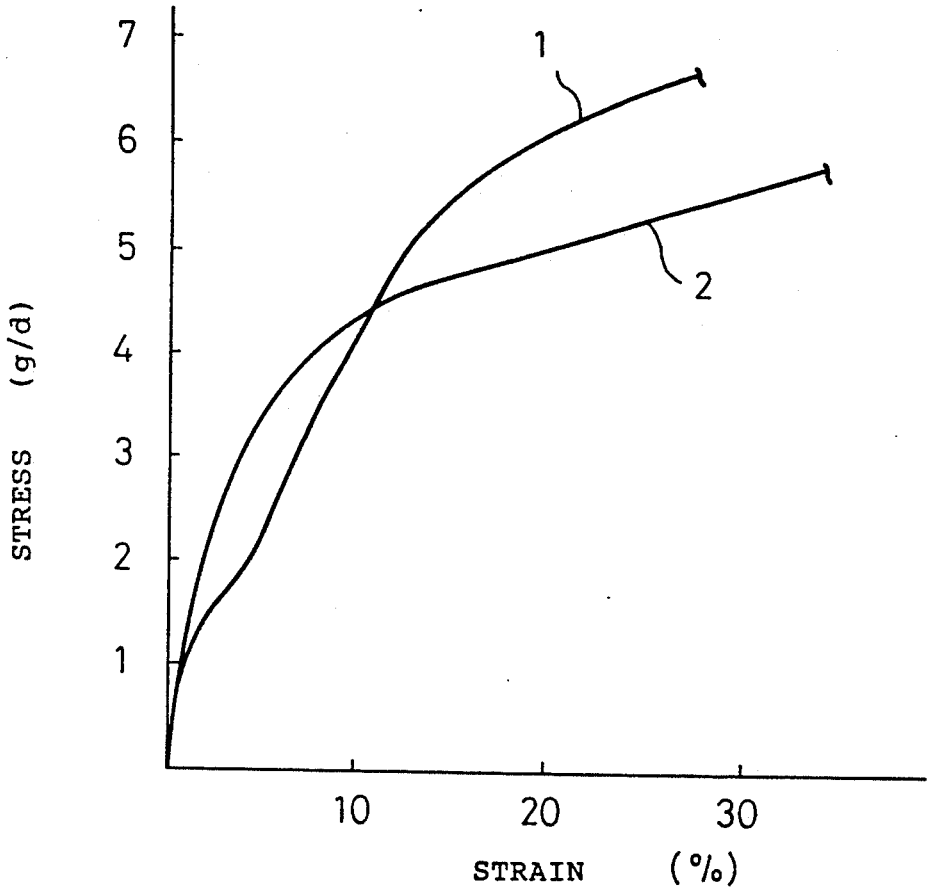
FIG. 1 is a graph showing an example of a stress-strain curve of the polyester fibers usable for the present invention.

The fabric material of the present invention useful for sports equipments is formed using a woven fabric comprising, as a principal fiber component, polyester fibers having an excellent resistance to sunlight and water and superior dimensional stability.

In the woven fabric for the fabric material of the present invention, the content of the polyester fibers is preferably 60 to 100%, and most preferably 80 to 100% by weight based on the entire weight of the woven fabric.

Where the content of the polyester fibers is less than 60% by weight, the resultant fabric material is sometimes unsatisfactory in resistance to tearing, resistance to weathering and dimensional stability.

The polyester usable for the present invention is preferably a polymer having 90 molar % or more, and most preferably 95 molar % or more, of repeating ethylene terephthalate units per molecule chain thereof. Particularly, it is preferable that the polyester usable for the present invention be polyethyleneterephthalate. The polyester optionally contains 10 molar % or less, and preferably 5 molar % or less of another repeating unit. The comonomers for forming the above-mentioned repeating units include, for example, isophthalic acid, naphthalene dicarboxylic acids, adipic acid, hydroxybenzoic acids, diethylene glycol, propylene glycol, trimellitic acid and pentaerythritol.

The polyester fibers usable for the present invention optionally contain an additive, for example, a stabilizing agent, coloring matter, and an antistatic agent.

For example, in the fabric material for forming a paraglider, if the basis weight of the fabric material is too high, the resultant paraglider exhibits a lowered gliding performance and is also difficult to carry or transport. In another example, if a fabric material for a spinnaker has an excessively high basis weight, the resultant spinnaker is significantly difficult to handle.

When the basis weight of the fabric material is too low, the resultant fabric material exhibits unsatisfactory tensile strength and tear strength. Therefore, the fabric material of the present invention should preferably have a basis weight of 20 to 100 g/m$^2$, and most preferably 30 to 50 g/m$^2$.

In the fabric material of the present invention, it is necessary that the tensile strength and the ultimate elongation thereof be 30 kg/5 cm or more and 18.0% or more, respectively. Generally, the tensile strength and the ultimate elongation of the fabric material is variable depending on the weaving structure and on whether a resin treatment has been applied. There is a tendency, when the tensile strength is high, for the ultimate elongation to be low. Even when the tensile strength is 30 kg/cm or more, if the ultimate elongation is lower than 18%, the resultant fabric material has an insufficient degree of durability, and therefore when sporting equipment made from the fabric material is suddenly filled with air and exposed to high wind pressure, there is a high probability that the sporting equipment will tear. On other hand, when a fabric material has a tensile strength of less than 30 kg/5 cm, and sporting equipment made from the fabric material is exposed to high wind pressure, the equipment has a high probability of tearing because of the low tensile strength thereof. Therefore, it is important to enhance the tear strength of the fabric material so that the fabric material simultaneously satisfies both a tensile strength of 30 kg/5 cm or more and an ultimate elongation of 18% or more.

The fabric material of the present invention has a burst strength of 0.18 kg/cm$^2$ or more per basis weight 10 g/m$^2$. If the burst strength is less than 0.18 kg/cm$^2$ per basis weight of 10 g/m$^2$, it is necessary to increase the basis weight of the fabric material, thereby increasing the overall weight of the resultant fabric material.

In the fabric material of the present invention, it is necessary that the tear strength thereof be 1.0 kg or more (measured by a single tongue method). If a fabric material has a tear strength of less than 1.0 kg, sports equipment, for example, a paraglider, made from the fabric material has a high probability of tearing as a result of high wind pressure while being used, and a spinnaker also has a high probability of tearing by a strong wind.

The fabric material of the present invention must have an air permeability of 1.0 ml/cm$^2$/sec or less, preferably 0.5 ml/cm$^2$/sec or less. If the air permeability is more than 1.0 ml/cm$^2$/sec, the resultant fabric material will exhibit lowered efficiency in utilizing the wind pressure and thus sporting equipment made from the fabric material, for example a paraglider has a reduced gliding capability thereby increasing the risk of an accident, and a spinnaker exhibits a reduced capability for effectively utilizing the wind.

If a resin treatment is applied to the fabric material of the present invention the resultant fabric material easily satisfies all of the specifications (1) to (6), though the material need not be resin treated. When the fabric material is resin-treated, the preferable resin material is selected from, for example, polyurethane resins, silicone resins, and polyvinyl chloride resins, which are very soft and durable.

The fabric material of the present invention comprises a woven fabric composed of warp and weft yarns comprising, as a principal fiber component, the above-mentioned polyester fibers.

Preferably, the polyester fibers simultaneously satisfy all of the following specifications (7) to (12):

(7) $0.95 \geqq [\eta]F \geqq 0.7$ (8) $3 \geqq DPF \geqq 1.5$ (9) $ST \geqq 6.0$

(10) $EL \geqq 20.0$

(11) $A \geqq 1.0$ and

(12) $0.5 \geqq B/A \geqq 0.2$ in which $[\eta]F$ represents intrinsic viscosity of the polyester fibers, DPF represents individual fiber thickness in denier of the polyester fibers, ST represents tensile strength in g/denier of the polyester fibers, EL represents ultimate elongation in % of the polyester fibers, A represents a gradient in g/denier/% of a stress-strain curve of the polyester fibers measured at a point at which the polyester fibers exhibit an elongation of zero, and B represents a minimum gradient in g/denier/% of a portion of the stress-strain curve of the polyester fibers in which a portion of the polyester fibers exhibit an elongation of from 0 to 4%.

The intrinsic viscosity $[\eta]F$ of the polyester fibers is an important factor that influences the tensile strength, the ultimate elongation, the durability and tearing resistance of the polyester fibers, and is preferably in the range of from 0.70 to 0.95, and most preferably from 0.80 to 0.95. When the $[\eta]F$ is less than 0.70, the resultant polyester fibers do not easily, simultaneously satisfy the specifications (9) and (10) and have an unsatisfactory tearing resistance. If the $[\eta]F$ is more than 0.95, the resultant polymer exhibits a significantly lowered filament-forming property and it becomes difficult to produce polyester fiber yarns free from undesirable fluffs without yarn-tearing.

The individual fiber thickness DPF of the polyester fibers usable for the present invention is necessarily in the range of from 1.5 deniers to 3.0 deniers, as shown in the specification (8), and when the DPF of the polyester fibers is less than 1.5 deniers, a disadvantage occurs in that the resultant fabric material made from the polyester fibers is too soft and is easily torn. Also, if the DPF is more than 3 deniers, a disadvantage occurs in that the resultant fabric material made from the polyester fibers is too rigid.

The tensile strength and ultimate elongation of the polyester fibers usable for the present invention are preferably 6.0 g/denier or more (the relationship (9)) and 20.0% or more (the relationship (10)), respectively. Generally, the ultimate elongation of the polyester fibers is reduced with an increase in tensile strength thereof. Even if the tensile strength is 6.0 g/denier or more, if the ultimate elongation is less than 20.0%, the resultant sports equipment, for example, a spinnaker, made from a polyester fiber-containing fabric material is easily deformed (elongated) when suddenly filled with a strong wind and thus exhibits an unsatisfactory wind energy-absorbing effect, which results in a high tearing probability.

Also, even if the ultimate elongation is 20% or more, if the tensile strength is less than 6.0 g/denier, the resultant sports equipment tears easily by a strong wind. Accordingly, the specifications (9) and (10) should preferably be satisfied simultaneously by the polyester fibers. Most preferably, the specifications of $ST \geqq 6.5$ g/denier and EL≧25.0% should simultaneously be satisfied by the polyester fibers.

The polyester fibers usable for the present invention should preferably satisfy the specifications (11) and (12) simultaneously.

In FIG. 1, a curve 1 is a stress-strain (S-S) curve of a preferable polyester for the present invention, and a curve 2 is a stress-strain curve of another polyester fiber.

In FIG. 1, the S-S curve 1 of the preferable polyester fiber for the present invention is in the form of the substantially reversed S and is characterized in that a minimum gradient of a portion of the curve with an elongation in the range of from 0 to 4% is significantly lower than a gradient of the curve at a point corresponding to an elongation of zero.

Generally, in an S-S curve of a fiber, a gradient of the curve at a point at which the fiber exhibits an elongation of zero corresponds to an elastic modulus of the fiber. In the present invention, the gradient A is preferably 1.0 g/denier/% or more (the relationship (11)). If this gradient is less than 1.0 g/denier/%, the resultant fabric material exhibits an unsatisfactory impact strength. Therefore, for example, when a spinnaker made from the fabric material is suddenly filled with air and subjected to high wind pressure, the spinnaker is easily deformed by the wind pressure and exhibits unsatisfactory dimensional stability.

As shown in the relationship (12), the ratio B/A of a minimum gradient B of a portion of the S-S curve of the polyester fiber in a range of elongation of from 0 to 4% to the above-mentioned gradient A is preferably 0.2 to 0.5, and most preferably 0.3 to 0.4.

Generally, the ratio B/A relates to a balance between the dimensional stability of a fiber when subjected to an external force and the tensile strength of the fiber, namely to the elastic recovery capability of the fiber deformed by the external force.

In the present invention, if the ratio B/A is more than 0.5, a fabric product made from the resultant polyester fibers, for example, a spinnaker, exhibits reduced wind energy-absorbing properties due to deformation thereof when filled with wind and subjected to a high wind pressure, and thus a reduced resistance to tearing.

If the ratio B/A is less than 0.2, a fabric product made from the resultant fibers exhibits an unsatisfactory dimensional stability when subjected to an external force and thus a lowered resistance to deformation.

The fabric material of the present invention preferably has a shrinkage of 3 to 6% in boiling water. The fabric material having the above-mentioned boiling water shrinkage exhibits good finishing properties and a satisfactory texture.

The fabric comprising, as a principal fiber component, the polyester fibers having the above-mentioned characteristics is useful as a fabric for wind filling sports equipment, for example, paragliders, hanggliders, yacht sails, spinnakers or stuntkites, because the above-mentioned characteristics of the polyester fibers respond well to stress imported to the fabric material when suddenly filled with wind and to a rapid change in stress, and enhance the tearing resistance of the fabric material. Also, the various characteristics of the polyester fibers, for example, high dimensional stability, a high resistance to sunlight and water, and its light weight, which makes it convenient to carry and transport, can be fully utilized.

The fabric material of the present invention is preferably formed from principal component yarns and fabric-reinforcing thick yarns; the thickness of the thick yarns being 2 to 5 times that of the principal component yarns. This fabric material preferably comprises a woven fabric having a reinforcing check-patterned structure formed from warp and weft yarn groups, each of which is composed of two reinforcing thick yarns and 2 to 5 principal component yarns arranged between the two reinforcing thick yarns.

Each thick yarn may be composed of 2 to 5 principal doubled component yarns. The thick yarns are used as reinforcing yarns for the woven fabric and exhibit a significant resistance to deformation and tearing.

If the thickness of the thick yarns is less than twice the thickness of the principal component yarns, the resultant thick yarn does not exhibit a sufficient reinforcing effect. Also, if the thickness of the thick yarn is more than 5 times that of the principal component yarns, the resultant woven fabric is less soft, whereas the resultant thick yarns exhibit an enhanced reinforcing effect.

If the number of principal component yarns arranged between two thick yarns is less than 2, the two thick yarns exhibit a similar behavior to that of a doubled yarn of the two thick yarns, and thus the resultant woven fabric is less soft and sports equipment produced from the woven fabric exhibits a lowered wind pressure-resistance.

If the number of principal component yarns arranged between two thick yarns is more than 5, the distance between the two thick yarns becomes excessive and thus the mutual reinforcing effect of the two thick yarns becomes insufficient and unsatisfactory.

In the polyester fiber woven fabric usable for the present invention, the ratio in weight of the thick yarns to the total weight of the yarns in the fabric is preferably 5 to 50% If this ratio is less than 5%, the reinforcing effect by the thick yarns becomes insufficient. Also, if the ratio is more than 50%, the resultant woven fabric exhibits an unsatisfactory appearance and texture.

In a preferable process for producing the polyester fibers usable for the present invention, for example, polyester resin chips having an intrinsic viscosity $[\eta]c$ of about 0.8 to 1.05 are melted, and the polymer melt is extruded through a melt-spinning nozzle. In this melt-spinning procedure, a heated spinning zone is formed by heating the air immediately below the spinning nozzle, and filamentary polymer melt streams passing through the heated zone are cooled, the cooled filaments are provided with an oiling agent, and the resultant undrawn filaments are wound through a taking-up roller, and then drawn. In another process, the filaments taken-up through the taking-up roller are drawn directly without winding.

The drawing procedure of the former process is explained with reference to FIG. 2.

Figure 2:
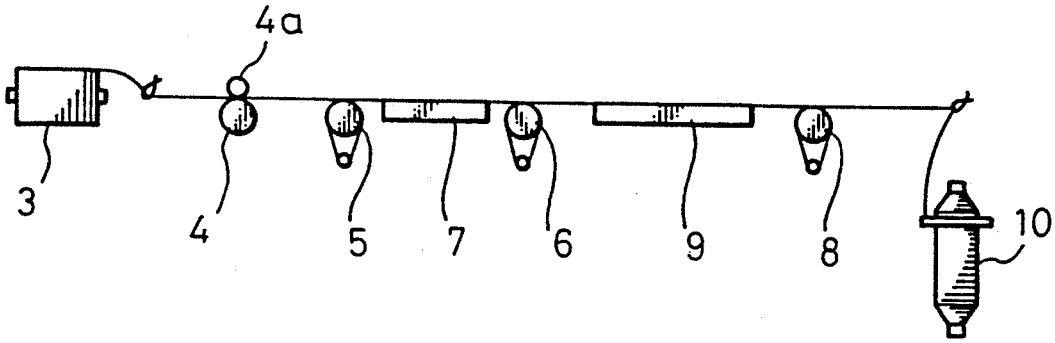
FIG. 2 is a diagram illustrating an embodiment of the process for producing the polyester fibers from which the fabric material of the present invention is formed.

In FIG. 2, undrawn polyester multifilaments 3 are fed to a feed roller 4 pressed by a nip roller 4a, heated on a heating roller 5 at a temperature equal to or more than the glass transition point of the filaments, while applying a small stretch to the undrawn filaments between the feed roller and a heating roller 5, and drawn between the roller 5 and the roller 6 while applying a heat treatment using a heating member 7, such as heating plate, at a temperature equal to or more than the crystallizing temperature of the polyester filaments. The drawn filaments are heat treated between the roller 6 and the roller 8 using a heating member 9 under relaxed conditions.

The tensile strength, ultimate elongation, the gradients A and B and the ratio B/A of the polyester fibers usable for the present invention can be set respectively to desired values by properly controlling the draw ratio, relaxing rate and heat treating temperature of the above-mentioned procedures. The gradients A and B and the ratio B/A are especially influenced by the relaxing rate, and the heat treating temperature under relaxed conditions. Therefore, the relaxing rate is preferably controlled to 2 to 7% and the heat-treating temperature is preferably adjusted to a level equal to or more than the drawing temperature.

EXAMPLE

The present invention will be further explained using the following examples.

In the examples, the tensile strength, ultimate elongation, burst strength, tear strength and air permeability of the fabric material, polymer intrinsic viscosity, and stress-strain curve and relaxing ratio, of the fibers were measured using the following test methods.

Tensile Strength and Ultimate Elongation of Fabric Material

The tensile strength and the ultimate elongation of the fabric material were measured in accordance with JIS L-1096-76-6.12.1.

Cut Strip Method

Namely, 3 specimens having dimensions of 5 cm×25 cm were prepared in each of the warp and weft directions from a fabric material, and subjected to a tensile test using a tensile tester (Instron type) equipped with clamps having a width of 5 cm or more, in which tester, the specimen is held at a distance of 10 cm between the clamps at a stretching rate of 10 cm/min.

When the stretched specimen tore the tensile strength and the ultimate elongation of the specimen were determined.

Burst Strength

A circular fabric specimen having a diameter of 108 mm was fixed at the edge portion thereof, a nitrogen gas was fed from a gas-supply inlet having a diameter of 40 mm toward the lower surface of the fabric specimen under a pressure of 2 to 3 kg/cm$^2$, and an inside pressure under which the specimen burst. The burst strength of the specimen was calculated by dividing the measured inside pressure and basis weight (g/m$^2$) of the specimen and multiplying by 10.

Air Permeability

The air permeability was measured using a Frazir type permeability tester in accordance with JIS L-1096-76-6.27, Method A.

Tear Strength

The tear strength was measured in accordance with JIS L-1096-76-6.15.2, Single Tongue Method.

Five specimens having dimensions of 10 cm×20 cm were prepared in each of the warp and weft directions from the fabric material, and subjected to a test using an Instron type tester in which the specimen was held by two clamps and a cut was formed at the center of the held specimen. The specimen was tested at a tensile rate of 10 cm/min, and the results are recorded on recording paper.

From the recorded data, a minimum value and a maximum value were deleted, and the remaining second to fourth values were averaged.

Intrinsic Viscosity

The polymer intrinsic viscosity was measured at a concentration of 1.2 g/100 ml in o-chlorophenol at a temperature of 35° C.

S-S Curve of Fiber

A measurement was carried out at a specimen length of 20 cm, at a tensile rate of 10 cm/min, using an Instron type tester and the results were recorded on a suitable recording paper. From the recorded S-S curve, the necessary data were read. When a specimen was set in the Instron type tester, a load of 0.1 g/denier was applied to a lower end of the specimen so that the specimen did not become loose.

The tensile strength in g/denier of the specimen was calculated by dividing the measured strength value by denier value of the specimen. The ultimate elongation was an elongation value of the specimen at tearing thereof. The gradient A is a gradient in (g/denier/%) of a tangential line drawn at a point of the S-S curve, at which point the elongation of the specimen is zero. The gradient B is a minimum gradient (g/denier/%) of tangential lines drawn on a portion of the S-S-curve in which a portion of the specimen exhibits an elongation of from 0 to 4%. The measurement was repeated fine times and the resultant values were averaged.

Relaxing Rate of Fiber

Provided that the peripheral speed of a drawing roller is represented by V, and the peripheral speed of a relaxing roller is represented by $V_2$, the relaxing rate was calculated in accordance with the following equation:

$$\text{Relaxing rate (\%)} = \{(V_1 - V_2)/V_1\} \times 100$$

When the calculated value was positive, the fiber was relaxed.

EXAMPLES 1 TO 12 AND COMPARATIVE EXAMPLES 1 TO 8

In each of Examples 1 to 12 and Comparative Examples 1 to 8, a woven fabric was produced from polyethyleneterephthalate multifilament yarns having polymer intrinsic viscosity, individual fiber thickness, tensile strength, ultimate elongation, gradient (A) and the gradient ratio B/A as indicated in Table 1 and a denier of 40. The woven fabric had the following structure.

Weaving structure: Plain weave

Density:

Warp—110 yarns/25.4 mm

Weft—110 yars/25.4 mm

In each of warp and weft weaving structure units, 20 polyethyleneterephthalate multifilament yarns having a denier of 40 were successively arranged, one thick yarn produced by doubling three 40 denier multifilament yarns, as mentioned above, was arranged next to the above-mentioned 20 yarns, two 40 denier multifilament yarns, as mentioned above, were arranged next to the thick yarn, and then one thick yarn produced by doubling three 40 denier multifilament yarns, as mentioned above, was arranged next to the two 40 denier multifilament yarns.

The resultant woven fabric was scoured, pre-heat set and dyed in a customary manner, and then heat-treated under predetermined conditions.

The resultant woven fabric was coated with a polyurethane resin in an amount of 5.5 g/m$^2$. A coated woven fabric material having a basis weight of 48 g/m$^2$ was obtained. Each resultant fabric material had an air permeability of 0.5 ml/cm$^2$/sec or less.

The properties of the resultant fabric materials are indicated in Table 1.

polyester multifilament yarns (40 denier). Each of the warp and weft weaving structure units was as indicated in Table 2.

Each resultant woven fabric had warp and weft densities of 110 yarns/25.4 mm, an air permeability of 0.5 ml/cm$^2$/sec or less and a basis weight of 48 g/m$^2$.

The properties of the fabrics, and the evaluation results of the fabric as a paraglider fabric are shown in Table 3.

In the above-mentioned evaluation, light transmission through gaps between the yarns in the fabric was evaluated visually. The evaluation results were included in the general evaluation. Namely, the larger the light transmission through the gaps between yarns, the lower the general evaluation.

TABLE 1

| Item Example No. | | Properties of polyester fibers | | | | | | Properties of fabric material | | | | | |
|---|---|---|---|---|---|---|---|---|---|---|---|---|---|
| | | [η]F | DPF (denier) | Tensile strength (g/d) | Ultimate elongation (%) | Gradient A (g/d/%) | Gradient ratio B/A | Tensile strength (kgf) | Ultimate elongation (%) | Burst strength (kg/10g/m$^2$) | Tear strength (kgt) | Touch (*)$_1$ | General evaluation |
| Example | 1 | 0.80 | 2 | 6.5 | 25 | 1.2 | 0.4 | 52 | 24 | 0.21 | 3.50 | 4 | 3 |
| | 2 | " | " | 6.2 | 28 | " | 0.3 | 49 | 27 | 0.19 | 3.30 | 4 | 3 |
| | 3 | " | " | 6.8 | 23 | " | 0.4 | 55 | 22 | 0.20 | 3.25 | 4 | 3 |
| | 4 | " | " | 6.9 | 20 | " | 0.4 | 56 | 19 | 0.19 | 3.20 | 4 | 3 |
| | 5 | " | " | 6.0 | 30 | " | 0.3 | 45 | 29 | 0.18 | 3.00 | 4 | 3 |
| Comparative Example | 1 | " | " | 5.8 | 30 | " | 0.3 | 29 | 29 | 0.15 | 2.40 | 4 | 1 |
| | 2 | " | " | 7.0 | 18 | " | 0.4 | 55 | 16 | 0.15 | 2.66 | 4 | 1 |
| Example | 6 | " | " | 6.5 | 26 | " | 0.2 | 52 | 25 | 0.20 | 3.30 | 4 | 2 |
| | 7 | " | " | 6.4 | 23 | " | 0.5 | 51 | 21 | 0.19 | 3.20 | 4 | 2 |
| Comparative Example | 3 | " | " | 6.5 | 26 | " | 0.1 | 52 | 24 | 0.15 | 3.00 | 4 | 1 |
| | 4 | " | " | 6.4 | 22 | " | 0.7 | 50 | 21 | 0.16 | 2.90 | 4 | 1 |
| Example | 8 | 0.90 | " | 6.5 | 27 | " | 0.4 | 53 | 25 | 0.22 | 3.65 | 4 | 3 |
| | 9 | 0.70 | " | 6.3 | 23 | " | 0.4 | 49 | 21 | 0.18 | 3.00 | 4 | 3 |
| Comparative Example | 5 | 0.65 | " | 6.1 | 25 | " | 0.4 | 40 | 24 | 0.15 | 2.20 | 4 | 1 |
| Example | 10 | 0.80 | 3 | 6.5 | 26 | " | 0.4 | 51 | 25 | 0.21 | 3.70 | 3 | 3 |
| Comparative Example | 6 | " | 3.5 | 6.5 | 26 | " | 0.4 | 52 | 25 | 0.21 | 3.70 | 1 | 2 |
| Example | 11 | " | 1.5 | 6.5 | 23 | " | 0.4 | 51 | 22 | 0.19 | 3.30 | 4 | 3 |
| Comparative Example | 7 | " | 1.0 | 6.5 | 22 | " | 0.4 | 48 | 21 | 0.17 | 2.20 | 4 | 1 |
| Example | 12 | " | 2 | 6.4 | 22 | 1.0 | 0.4 | 50 | 21 | 0.20 | 3.00 | 4 | 3 |
| Comparative Example | 8 | " | " | 6.4 | 22 | 0.8 | 0.4 | 50 | 21 | 0.17 | 2.80 | 4 | 1 |

Note:
(*)$_1$ class
4 Excellent
3 Good
2 Satisfactory
1 Bad

EXAMPLES 13 TO 20 AND COMPARATIVE EXAMPLE 9

In each of the Examples 13 to 20 and Comparative Example 9, a plain weave was produced from the same

TABLE 2

| Item Example No. | | Warp and weft weaving structure units | The number of yarns in each of warp and weft weaving structure units | Proportion of doubled thin yarns in each of warp and weft weaving structure units (%) |
|---|---|---|---|---|
| Comparative Example | 9 | 28 thin (*)$_2$ yarns | 28 | 0 |
| Example | 13 | 25 thin yarns/1 thick yarn (*)$_4$ | 28 | 10.7 |
| Example | 14 | 20 thin yarns/1 thick yarn (*)$_4$/2 thin yarns/1 thick yarn (*)$_4$ | 28 | 21.4 |
| Example | 15 | 18 thin yarns/1 thick yarn (*)$_5$/2 thin yarns/1 thick yarn (*)$_5$ | 28 | 28.5 |
| Example | 16 | 16 thin yarns/1 thick yarn (*)$_3$/2 thin yarns/1 thick yarn (*)$_3$ /2 thin yarns/1 thick yarn (*)$_5$ | 28 | 28.5 |
| Example | 17 | 15 thin yarns/1 thick yarn (*)$_4$/2 thin yarns/ 1 thick yarn (*)$_4$ /2 thin yarns/1 thick yarn (*)$_4$ | 28 | 32.1 |
| Example | 18 | 4 thin yarns/1 thick yarn (*)$_4$ | 7 | 42.9 |
| Example | 19 | 2 thin yarns/1 thick yarn (*)$_3$ | 4 | 50 |

TABLE 2-continued

| Item Example No. | Warp and weft weaving structure units | The number of yarns in each of warp and weft weaving structure units | Proportion of doubled thin yarns in each of warp and weft weaving structure units (%) |
|---|---|---|---|
| Example 20 | 22 thin yarns/1 thick yarn $(*)_6$ | 28 | 21.4 |

Note:
$(*)_2$ Thin yarn 40 denier polyester multifilament yarn
$(*)_3$ Thick yarn composed of 2 doubled 40 denier thin yarns
$(*)_4$ Thick yarn composed of 3 doubled 40 denier thin yarns
$(*)_5$ Thick yarn composed of 4 doubled 40 denier thin yarns
$(*)_6$ Thick yarn composed of 6 doubled 40 denier thin yarns

TABLE 3

| Item Example No. | Tensile strength (kg/5cm) | Ultimate elongation (%) | Burst strength kg/cm$^2$ | Tear strength (kg) | Touch | Appearance | General evaluation |
|---|---|---|---|---|---|---|---|
| Comparative Example 9 | 55 | 22 | 0.13 | 1.50 | 4 | 4 | 2 |
| Example 13 | 5 | 2 | 0.18 | 2.05 | 4 | 4 | 2-3 |
| Example 14 | 55 | 22 | 0.20 | 3.25 | 4 | 4 | 3 |
| Example 15 | 55 | 22 | 0.24 | 3.37 | 4 | 3 | 3 |
| Example 16 | 55 | 22 | 0.21 | 3.25 | 4 | 4 | 3 |
| Example 17 | 55 | 22 | 0.24 | 3.37 | 4 | 3 | 3 |
| Example 18 | 55 | 22 | 0.24 | 3.25 | 3 | 3 | 3 |
| Example 19 | 55 | 22 | 0.22 | 3.05 | 3 | 3 | 3 |
| Example 20 | 5 | 22 | 0.23 | 2.85 | 2 | 2 | 3 |

Note:
4 Excellent
3 Good
2 Satisfactory
1 Bad

EXAMPLES 21 TO 28 AND COMPARATIVE EXAMPLES 10 TO 15

In each of Examples 21 to 28 and Comparative Examples 10 to 15, a plain weave was produced from polyester multifilament yarns having a thickness as indicated in Table 4 and consisting of polyester filaments having properties as indicated in Table 4 and an individual fiber thickness of 2.0 denier, a gradient A of 1.2 g/d/%, and a gradient ratio B/A of 0.4.

The plain weave had the following warp and weft weaving structure units and densities.

Warp and weft densities:

| | |
|---|---|
| 20 denier yarns | 150 yarns/25.4 mm |

-continued

| | |
|---|---|
| 40 denier yarns | 110 yarns/25.4 mm |
| 75 denier yarns | 80 yarns/25.4 mm |

Warp and weft weaving structure units: 20 thin yarns/1 thick yarn/2 thin yarns/1 thick yarn

| | | |
|---|---|---|
| Note: | Thin yarn | 20, 40, or 75 denier yarns |
| | Thick yarn | composed of doubled three 20, 40 or 75 denier thin yarns |

The resultant woven fabric was treated in the same manner as in Example 1.

The resultant finished woven fabric had properties as indicated in Table 4.

TABLE 4

| Item Example No. | Fibers [η]F | Fibers DPF (d) | Fibers ST (g/d) | Fibers EL (%) | Yarns Thickness (d) | Yarns Filament number | Woven fabric Basis weight (g/m$^2$) | Woven fabric Tensile strength (kg/5cm) | Woven fabric Ultimate elongation (%) | Woven fabric Burst strength (kg/cm$^2$) | Woven fabric Tear strength (kg) | Woven fabric Air permeability (ml/cm$^2$/sec) | Woven fabric Touch | Woven fabric General evaluation |
|---|---|---|---|---|---|---|---|---|---|---|---|---|---|---|
| Comparative Example | | | | | | | | | | | | | | |
| 10 | 0.6 | 2.0 | 6.1 | 23 | 20 | 10 | 25 | 25 | 22 | 0.17 | 0.95 | 0.45 | 1 | 1 |
| 11 | 0.7 | 2.0 | 6.3 | 24 | 20 | 10 | 25 | 28 | 23 | 0.19 | 1.40 | 0.35 | 1 | 1 |
| Example | | | | | | | | | | | | | | |
| 21 | 0.8 | 2.0 | 6.5 | 25 | 20 | 10 | 25 | 31 | 24 | 0.21 | 1.72 | 0.25 | 4 | 4 |
| 22 | 0.9 | 2.0 | 6.8 | 27 | 20 | 10 | 25 | 34 | 26 | 0.23 | 2.00 | 0.30 | 4 | 4 |
| Comparative Example | | | | | | | | | | | | | | |
| 12 | 0.6 | 2.0 | 6.1 | 23 | 40 | 20 | 48 | 42 | 22 | 0.16 | 2.00 | 0.03 | 1 | 1 |
| Example | | | | | | | | | | | | | | |
| 23 | 0.7 | 2.0 | 6.3 | 24 | 40 | 20 | 48 | 48 | 23 | 0.19 | 2.70 | 0.03 | 3 | 3 |
| 24 | 0.8 | 2.0 | 6.5 | 25 | 40 | 20 | 48 | 54 | 24 | 0.21 | 3.50 | 0.03 | 4 | 4 |
| 25 | 0.9 | 2.0 | 6.8 | 29 | 40 | 20 | 48 | 59 | 26 | 0.23 | 4.00 | 0.03 | 4 | 4 |
| Comparative Example | | | | | | | | | | | | | | |

TABLE 4-continued

| Item Example No. | Fibers [η]F | Fibers DPF (d) | Fibers ST (g/d) | Fibers EL (%) | Yarns Thickness (d) | Yarns Filament number | Woven fabric Basis weight (g/m²) | Woven fabric Tensile strength (kg/5cm) | Woven fabric Ultimate elongation (%) | Woven fabric Burst strength (kg/cm²) | Woven fabric Tear strength (kg) | Woven fabric Air permeability (ml/cm²/sec) | Woven fabric Touch | Woven fabric General evaluation |
|---|---|---|---|---|---|---|---|---|---|---|---|---|---|---|
| 13 | 0.6 | 2.0 | 6.1 | 23 | 74 | 37 | 85 | 84 | 22 | 0.16 | 3.54 | 0.03 | 1 | 1 |
| Example | | | | | | | | | | | | | | |
| 26 | 0.7 | 2.0 | 6.3 | 24 | 74 | 37 | 85 | 93 | 23 | 0.19 | 3.72 | 0.03 | 2 | 2 |
| 27 | 0.8 | 2.0 | 6.5 | 25 | 74 | 37 | 85 | 110 | 24 | 0.22 | 6.20 | 0.03 | 2 | 2 |
| 28 | 0.9 | 2.0 | 6.8 | 29 | 74 | 37 | 85 | 125 | 26 | 0.24 | 7.00 | 0.03 | 2 | 2 |
| Comparative Example | | | | | | | | | | | | | | |
| 14 | 0.8 | 2.0 | 6.5 | 25 | 16 | 8 | 18 | 23 | 24 | 0.22 | 1.28 | 1.5 | 1 | 1 |
| 15 | 0.7 | 2.0 | 6.5 | 25 | 100 | 50 | 110 | 146 | 23 | 0.21 | 8.02 | 0.03 | 1 | 1 |

Note:
4 Excellent
3 AGood
2 Satisfactory
1 Bad

We claim:

1. A fabric material for wind-filling sporting goods, comprising a woven fabric comprising, as a principal fiber component, polyester fibers, which satisfies the following specifications (1) to (6):

(1) 100≧fabric basis weight (g/m²)≧20
(2) tensile strength (kg/5 cm)≧30
(3) ultimate elongation (%)≧18
(4) burst stength (kg/cm²)≧0.18
(5) tear strength (kg)≧1.0 and
(6) air permeability (ml/cm²/sec)≦1.0

2. The fabric material for wind-filling sporting goods as claimed in claim 1, wherein the polyester fibers satisfy the following specifications (7) to (12):

(7) 0.95≧[η]F≧0.7
(8) 3≧DPF≧1.5
(9) ST≧6.0
(10) EL≧20.0
(11) A≧1.0 and
(12) 0.5≧B/A≧0.2 in which [η]F represents an intrinsic viscosity of the polyester fibers; DPF represents an individual fiber thickness in denier of the polyester fibers; ST represents tensile strength in g/denier of the polyester fibers; EL represents an ultimate elongation in % of the polyester fibers; A represents a gradient in g/denier/% of a stress-strain curve of the plyester fibers measured at a point at which the polyester fibers exhibit an elongation of zero; and B, represents a minimum gradient in g/denier/% of a portion of the stress-strain curve of the polyester fibers in which a portion of the polyester fibers exhibits an elongation of 0 to 4%.

3. The fabric material for wind-filling sporting goods as claimed in claim 2, wherein the fabric is a woven fabric composed of principal yarns and reinforcing large thickness yarns. The thickness of the large thickness yarns is 2 to 5 times that of the principal yarns, and the weaving structure of the woven fabric is a check-patterned reinforcing structure composed of warp and weft groups, each consisting of a pair of large thickness yarns and 2 to 5 principal yarns located between the pair of the large thickness yarns.

* * * * *